US005322137A

United States Patent [19]

Gonzales

[11] Patent Number: 5,322,137

[45] **Date of Patent: * Jun. 21, 1994**

[54] ROTATING HEAD WITH ELASTOMERIC MEMBER ROTATING ASSEMBLY

[75] Inventor: Don E. Gonzales, Cordell, Okla.

[73] Assignee: The SydCo System, Cordell, Okla.

[ * ] Notice: The portion of the term of this patent subsequent to Aug. 11, 2009 has been disclaimed.

[21] Appl. No.: 965,111

[22] Filed: Oct. 22, 1992

[51] Int. Cl.[5] ..... E21B 33/03

[52] U.S. Cl. ..... 175/195; 166/84; 277/31

[58] Field of Search ..... 175/195, 209; 166/82, 166/84; 277/3, 31; 285/16

[56] References Cited

U.S. PATENT DOCUMENTS

| | | | |
|---|---|---|---|
| 3,400,938 | 9/1968 | Williams | 277/31 |
| 4,293,047 | 10/1981 | Young | 175/195 |
| 4,363,357 | 12/1982 | Hunter | 166/84 |
| 4,480,843 | 11/1984 | Springer | 277/31 |
| 4,526,243 | 7/1985 | Young | 175/195 |
| 4,531,591 | 7/1985 | Johnston | 175/57 |
| 4,560,001 | 12/1985 | Gonzales | 166/84 |
| 4,745,970 | 5/1988 | Bearden et al. | 166/84 |
| 5,137,084 | 8/1992 | Gonzales et al. | 166/84 |

*Primary Examiner*—Hoang C. Dang
*Attorney, Agent, or Firm*—Dunlap, Codding & Lee

[57] ABSTRACT

A rotating head having a bowl assembly and a rotating assembly disposed in a bowl opening formed in the bowl assembly. The rotating assembly consists of an elastomeric member having a bearing wall formed thereon bearingly engaging a portion of the bowl assembly for bearingly supporting the elastomeric member in the bowl assembly. The elastomeric member sealingly engages a portion of the bowl assembly for forming a seal between the rotating assembly and the bowl assembly.

39 Claims, 5 Drawing Sheets

ROTATING HEAD WITH ELASTOMERIC MEMBER ROTATING ASSEMBLY

FIELD OF THE INVENTION

The present invention generally relates to rotating heads and, more particularly, but not by way of limitation, to a rotating head with a rotating assembly consisting of an elastomeric member sealingly and bearingly supported on a bowl assembly.

DESCRIPTION OF THE PREFERRED EMBODIMENTS

Figure 1:
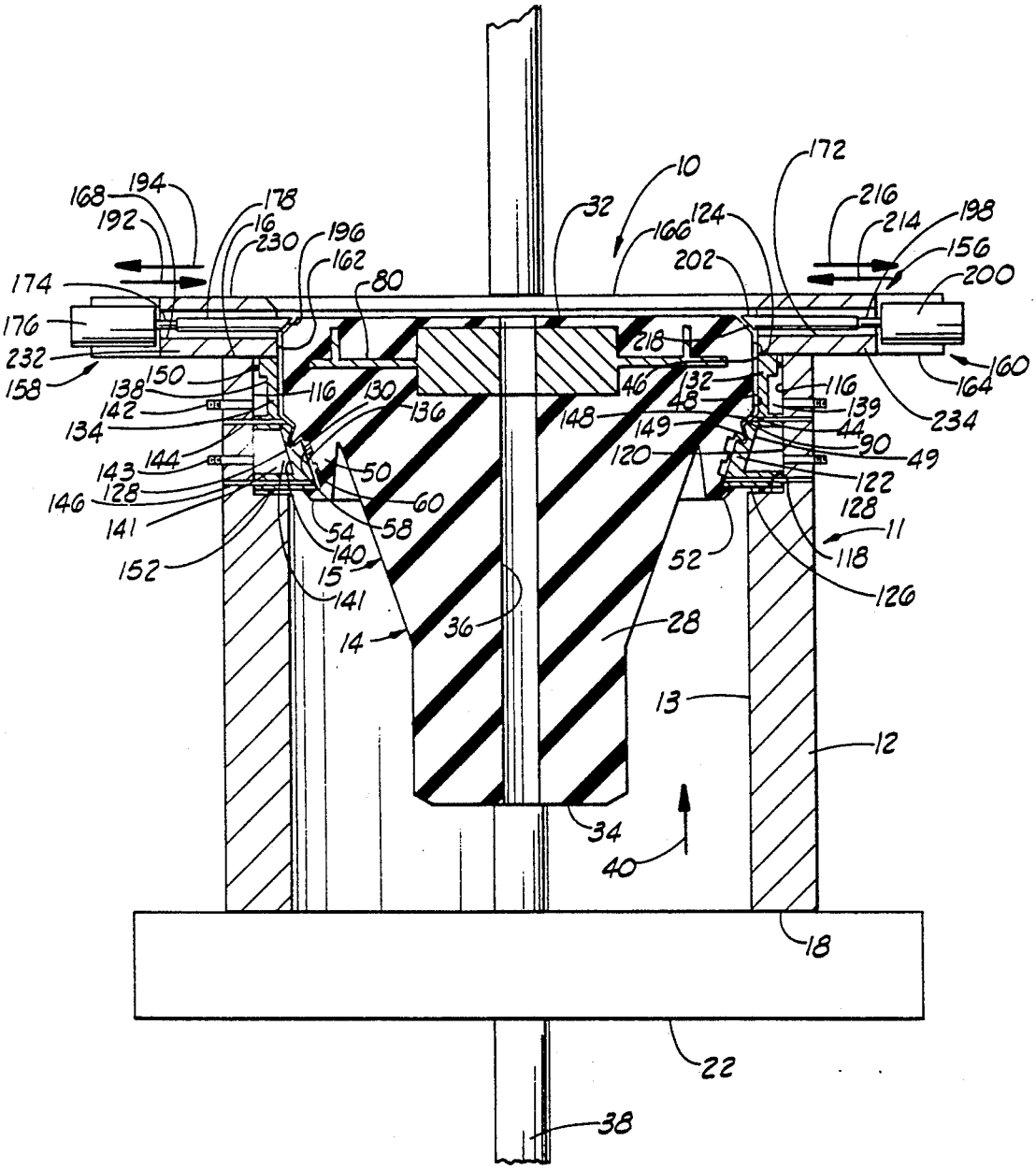
FIG. 1 is a sectional view of a rotating head constructed in accordance with the present invention.
Figure 2:
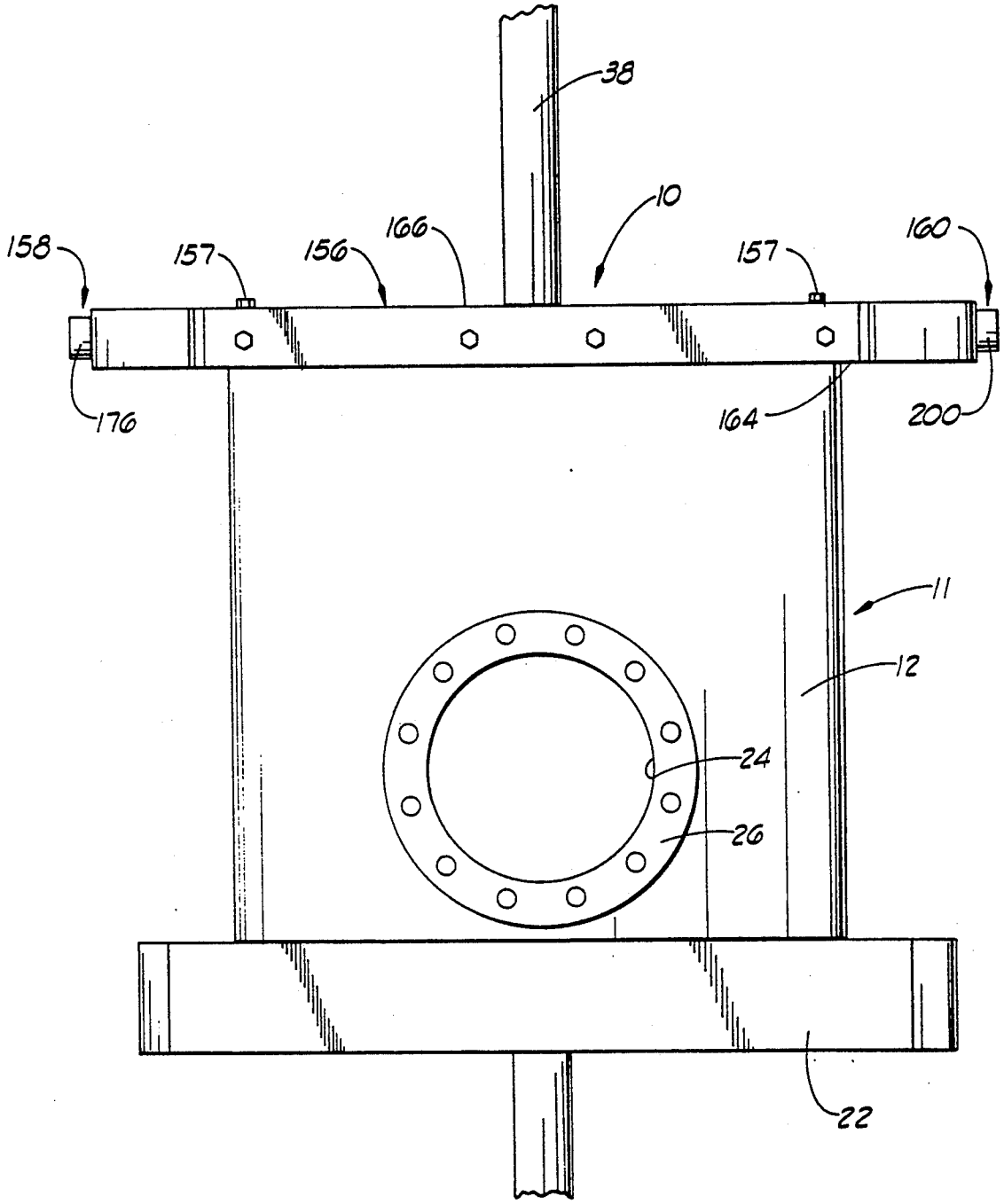
FIG. 2 is a side elevational view of the rotting head of FIG. 1.
Figure 3:
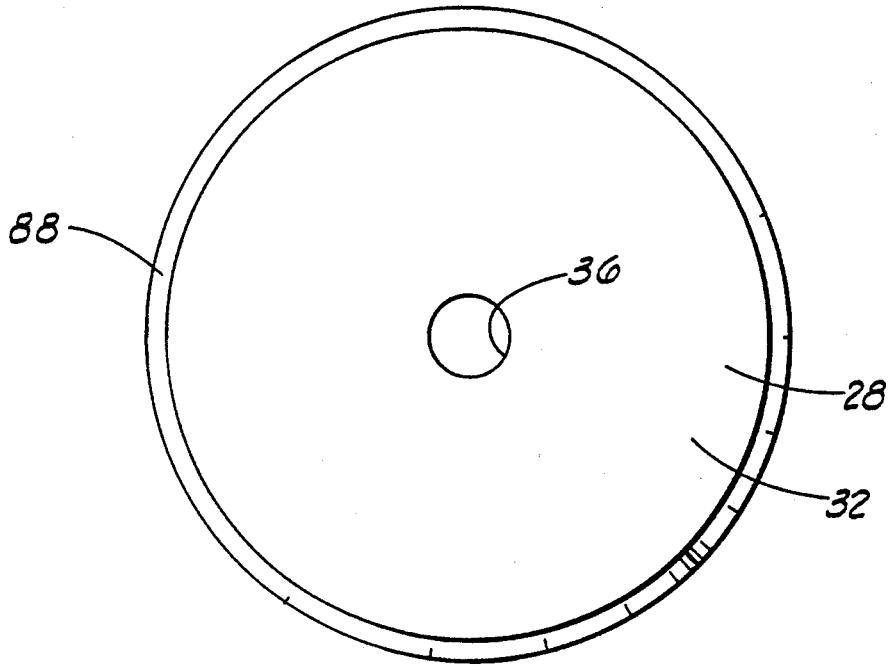
FIG. 3 is a top elevational view of the rotating assembly used in the rotating head of FIGS. 1 and 2.

Shown in FIGS. 1 and 2 is a rotating head 10 which is constructed in accordance with the present invention. The rotating head 10 basically comprises a bowl assembly 11 having a bowl opening 13 (FIG. 1) formed therein and a rotating assembly 14 (FIG. 1) having an elastomeric member outer peripheral surface 15 (FIG. 1) disposed in the bowl opening 13. The rotating assembly 14 is rotatingly disposed in the bowl opening 13 and portions of the rotating assembly 14 sealingly engage portions of the bowl assembly 11 and other portions of the rotating assembly 14 bearingly engage portions of the bowl assembly 11 during the rotation of the rotating assembly 14 in the bowl assembly 11.

As shown in FIG. 1, the bowl assembly 11 comprises an outer bowl 12 having an upper end 16, a lower end 18. The bowl opening 13 more particularly extends through the outer bowl 12 intersecting the upper end 16 and the lower end 18 of the outer bowl 12. A connecting flange 22 (FIGS. 1 and 2) is formed on the lower end 18 of the outer bowl 12. The connecting flange 22 extends a distance radially from outer bowl 12.

A discharge opening 24 (FIG. 2) is formed through the outer bowl 12 and positioned generally between the upper end 16 and the lower end 18 of the outer bowl 12. The discharge opening 24 intersects the bowl opening 13. A discharge flange 26 (FIG. 2) is formed on the outer bowl 12 encompassing the discharge opening 24.

The rotating assembly 14 consists solely of an elastomeric member 28 (FIGS. 1, 3, 4 and 5). the elastomeric member 28 is supported within the bowl assembly 11; and the elastomeric member 28 bearingly and sealingly engages the bowl assembly 11 during operation of the rotating assembly 14.

As shown in FIGS. 1, 3, 4 and 5, the elastomeric member 28 has an upper end 32 and a lower end 34. A circularly shaped drive opening 36 (FIGS. 3 and 5) is formed through the elastomeric member 28 intersecting the upper and the lower ends 32 and 34 thereof. The drive opening 36 is sized and shaped to receive a kelly or drill pipe 38 (FIGS. 1 and 2). The drill pipe 38 has a circularly shaped cross section and the drive opening 36 is slightly smaller than the diameter of the drill pipe 38 so that, when the drill pipe 38 is extended through the drive opening 36 a sealing and gripping engagement is formed between the elastomeric member 28 and the drill pipe 38.

It should be noted that the drill pipe 38 may have a square or multi-sided cross-section in some instances. In this event, the diameter of the drive opening 36 is smaller than the effective diameter of the drill pipe 38 so that the sealing and gripping engagement between the elastomeric member 28 and the drill pipe 38 still is formed.

During the drilling operations at an oil well, gas well or oil and gas well drilling site (well drilling site), the drill pipe or kelly 38 is extended into the well bore (not shown in the drawings) and drilling fluid is passed into the borehole. A plurality of blowout preventers (not shown in the drawings) are connected to the well borehole and the rotating head 10 is connected to the upper most blowout preventer via the connecting flange 22. The drill pipe 38 extends through the rotating head 10 and through the blow-out preventers and into the well borehole. During the drilling operations, drilling fluid is passed from the well borehole, up through the blow-out preventers and up through the bowl opening 13 in a direction 40 (FIG. 1). The rotating head 10 is designed to divert the received drilling fluid out through the discharge opening 24 in a direction generally perpendicular to the direction 40 for passing the drilling fluid back to a fluid pit or pits (not shown) located at the well drilling site generally near the drilling operations. The drilling fluid commonly is referred to in the industry as drilling mud. The drill pipe 38 is rotated during the drilling operations. The elastomeric member 28 sealingly engages the drill pipe 38 to prevent the drilling fluid from being passed upwardly in the direction 40 through the rotating head 10 and onto the drilling platform floor or onto another portion of the drilling rig. The rotating head 10 functions to divert the received drilling fluid for passing the drilling fluid back to the mud pit or pits.

As the drill pipe 38 is rotated during the drilling operations, the rotating of the drill pipe 38 rotates the rotating assembly 14 due to the sealing and gripping engagement between the elastomeric member 21 and the drill pipe 38. As the rotating assembly 14 is rotated, the elastomeric member 28 bearingly engages a portion of the bowl assembly 11 for bearingly supported the rotating assembly 14 in the bowl opening 13. It is significant to note that the elastomeric member 28 provides the only bearing support for the rotating assembly 14 and the elastomeric member 28 also sealingly engages the bowl assembly 11 and the drill pipe 38.

Figure 4:
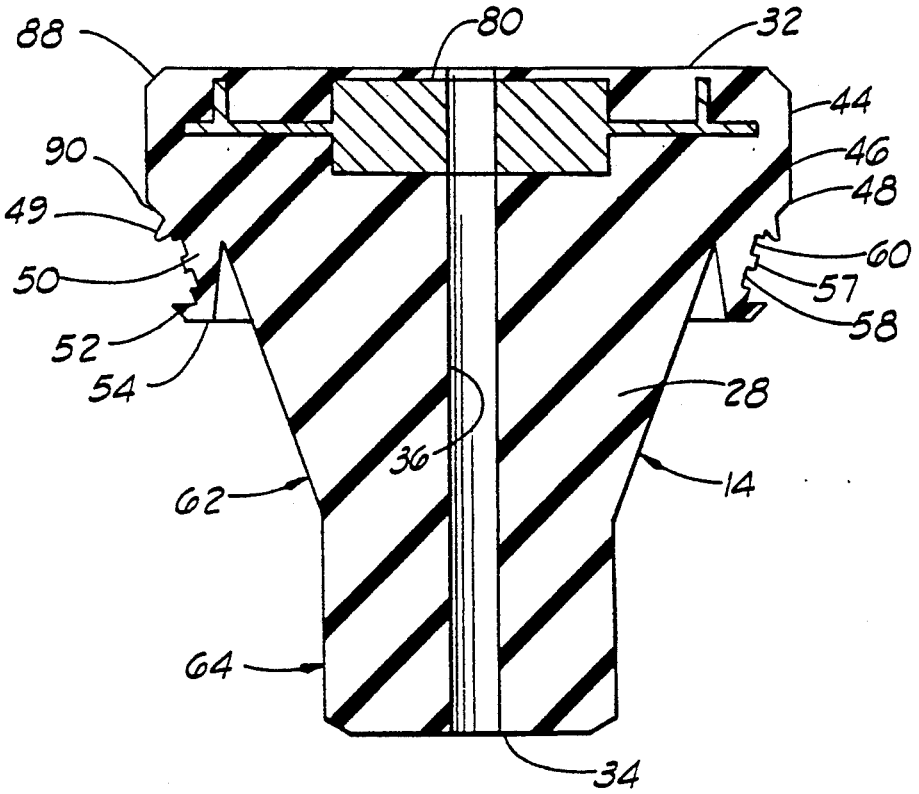
FIG. 4 is a side elevational view of the rotating assembly of FIG. 3.

A cylindrically shaped portion 44 (FIGS. 1 and 4) of the elastomeric member 28 is generally cylindrically shaped forming a flat, substantially vertically extending outer peripheral surface 46 (FIGS. 1 and 4). The cylindrically shaped portion 44 has an upper end corresponding to the upper end 32. The cylindrically shaped portion 44 extends from the upper end 32 of the elastomeric member 28 a distance generally toward the lower end 34 terminating with a lower end 48 (FIGS. 1 and 4) of the cylindrically shaped portion 44.

A sealing flange 50 (FIGS. 1 and 4) extends from the lower end 48 of the cylindrically shaped portion 44 a distance at an angle tapered inwardly toward the drive opening 36 of the elastomeric member 28. The sealing flange 50 extends circumferentially about the elastomeric member 28.

An annular lower seal member 52 (FIGS. 1 and 4) is formed on a lower end 54 (FIGS. 1 and 4) of the sealing flange 50. The lower seal member 52 extends radially outwardly from the sealing flange 50 and circumferentially about the elastomeric member 28.

An annular upper seal member 49 (FIGS. 1 and 4) is formed on the upper end of the sealing flange 50 generally adjacent the lower end 48 of the cylindrically shaped portion 44. The upper seal member 49 extends radially outwardly from the sealing flange 50 and circumferentially about the elastomeric member 28 so that the upper seal member 49 extends outwardly and downwardly from the sealing flange 50.

The tapered inwardly portion of the sealing flange 50 provides an outer peripheral surface 57 (FIG. 4). A pair of grooves 58 and 60 (FIGS. 1 and 4) are formed in an outer peripheral surface 57 of the sealing flange 50 and each of the grooves 58 and 60 extends circumferentially about the sealing flange 50.

A portion 62 (FIG. 4) of the elastomeric member 28 extends from about the sealing flange 50 toward the lower end 18 of the elastomeric member 28 and this portion 62 is tapered inwardly generally toward the drive opening 36. The portion 62 tapers inwardly toward the drive opening 36 terminating with a cylindrically shaped portion 64 (FIG. 4) which extends from the tapered portion 62 to the lower end 34 of the elastomeric member 28.

In a preferred form, the elastomeric member 28 is constructed of a single compound rubber having a hardness of about sixty Shore D. This is a relatively soft rubber composition and is suitable particularly for making the seals required of the elastomeric member 28. However, it has been found that, in some applications, additional rigidity is required for the bearing support functions of the elastomeric member 28. A circularly shaped metal insert 80 (FIGS. 1 and 4) is disposed in the elastomeric member 28 near the upper end 32 thereof. More particularly, the insert 80 is disposed about and encompasses the cylindrically shaped portion 44 of the elastomeric member 28 to provide additional rigidity to the cylindrically shaped portion 44. In some applications, the elastomeric member 28 may include other support means, other than the insert 80, disposed in the elastomeric member 28 if desired in a particular applications. In any event, the insert 80 or the other support means is an integral part of the elastomeric member 28 and the rotating assembly 14 still consists solely of the elastomeric member 28 even though the elastomeric member 28 includes support means such as the insert 80.

An annular tapered upper bearing wall 88 (FIGS. 1 and 4) is formed on the upper end 32 of the elastomeric member 28. The tapered upper bearing wall 88 intersects the upper end 32 and intersects a portion of the outer peripheral surface 46. A tapered lower bearing wall 90 (FIGS. 1 and 4) is formed on the lower end 48 of the cylindrically shaped portion 44. The tapered upper and the lower bearing walls 88 and 90 each extend circumferentially about the elastomeric member 28.

A circularly shaped recess 116 (FIG. 1 ) is formed in the upper end 32 of the outer bowl 12. The recess 116 extends a distance through the outer bowl 12 toward the lower end 34 of the outer bowl 12 terminating with a lower edge 118 (FIG. 1) and forming an inner peripheral surface 120 (FIG. 1).

A wear insert 122 (FIG. 1) is disposed generally within the recess 116. The wear insert 122 is cylindrically shaped. The wear insert 122 has an upper end 124 (FIG. 1), a lower end 126 (FIG. 1), an outer peripheral surface 128 (FIG. 1) and an inner peripheral surface 130 (FIG. 1). A portion 132 (FIG. 1) of the inner peripheral surface 130 is vertically oriented and extends from the upper end 124 a distance generally toward the lower end 126 terminating with a lower end 134 (FIG. 1) of the portion 132. The inner peripheral surface 130 also includes a tapered portion 136 (FIG. 1) which extends from the lower end 134 of the portion 132 at an angle inwardly terminating with the lower end 126 of the wear insert 122.

A first annular recess 138 (FIG. 1) is formed in the outer peripheral surface 128 of the wear inset 122 forming a first water cooling space 139 (FIG. 1). A second annular recess 140 (FIG. 1) is formed in the outer peripheral surface 128 of the wear insert 122 forming another second water cooling space 141 (FIG. 1).

A water inlet 142 is formed in the outer bowl 12 in communication with the first water cooling space 139. A water outlet 143 is formed through the outer bowl 12 in communication with the second water cooling space 141.

A pair of openings 144 and 146 FIG. 1) is formed through the outer bowl 12. Each of the openings 144 and 146 intersects the outer peripheral surface of the outer bowl 12 and the inner peripheral surface 120 formed by the recess 116. The openings 144 and 146 are in fluidic communication with respective openings in the wear insert 122.

A bearing surface 148 (FIG. 1) is formed on the inner peripheral surface 130 of the wear insert 122. The bearing surface 148 is angled outwardly and downwardly with respect to the outer peripheral surface 128. The bearing surface 148 bearingly engages the lower bearing wall 90 on the elastomeric member 28.

An annular seal recess 149 (FIG. 1) is formed in the inner peripheral surface 130 of the wear insert 122. The upper seal member 49 is disposed in the seal recess 149 in the wear insert 122.

An upper O-ring seal member 150 (FIG. 1) is disposed between the outer peripheral surface 128 of the wear insert 122 generally near the upper end 124 of the wear insert 122 and the inner peripheral surface 120 formed by the recess 116 in the outer bowl 12. A lower O-ring seal member 152 (FIG. 1) is disposed between the lower end 126 of the wear insert 122 and the lower edge 118 formed by the recess 116 in the outer bowl 12. The O-rings 150 and 152 form seals between the wear insert 122 and the outer bowl 12.

In operation, lubricant (grease) is inserted through the openings 144 and 146 for providing lubricant between the elastomeric member 28 and the wear insert 122. Water is inserted or passed into the water spaces 139 and 141 to provide cooling.

As shown in FIGS. 1 and 2, a cylindrically shaped clamp housing 156 is secured to the upper end 16 of the outer bowl 12. Portions of the clamp housing 156 extend a distance radially outwardly from the outer peripheral surface of the outer bowl 12. The clamp housing 156 is secured to the upper end 16 of the outer bowl 12 Via a plurality of bolts 157 (only some of the bolts 157 being shown in FIG. 2).

As shown in FIGS. 1 and 2, the rotating head 10 includes a pair of clamp means 158 and 160. The clamp means 158 and 160 are disposed generally on opposite sides of the outer bowl 12 about 180° apart. The clamp means 158 and 160 are identical in construction and operation.

A circularly shaped recess 162 (FIG. 1) is formed through a lower surface 164 (FIGS. 1 and 2) of the clamp housing 156. The recess 162 extends a distance from the lower surface 164 toward an upper surface 166 (FIGS. 1 and 2). The recess 162 has a diameter slightly larger than the diameter of the cylindrically shaped portion 44 of the elastomeric member 28. A portion of the cylindrically shaped portion 44 of the elastomeric member 28 is disposed in the recess 162 in the clamp housing 156.

A first opening 168 (FIG. 1) is formed through the clamp housing 156 with the first opening 168 intersecting an outer peripheral surface of the clamp housing 156. The first opening 168 extends through the clamp housing 156 and intersects the recess 162.

A second opening 172 (FIG. 1) is formed through the clamp housing 156. The second opening 172 intersects the outer peripheral surface of the clamp housing 156. The second opening 172 extends through the clamp housing 156 and intersects the recess 162. The first opening 168 is spaced about 180° from the second opening 172.

Figure 5:
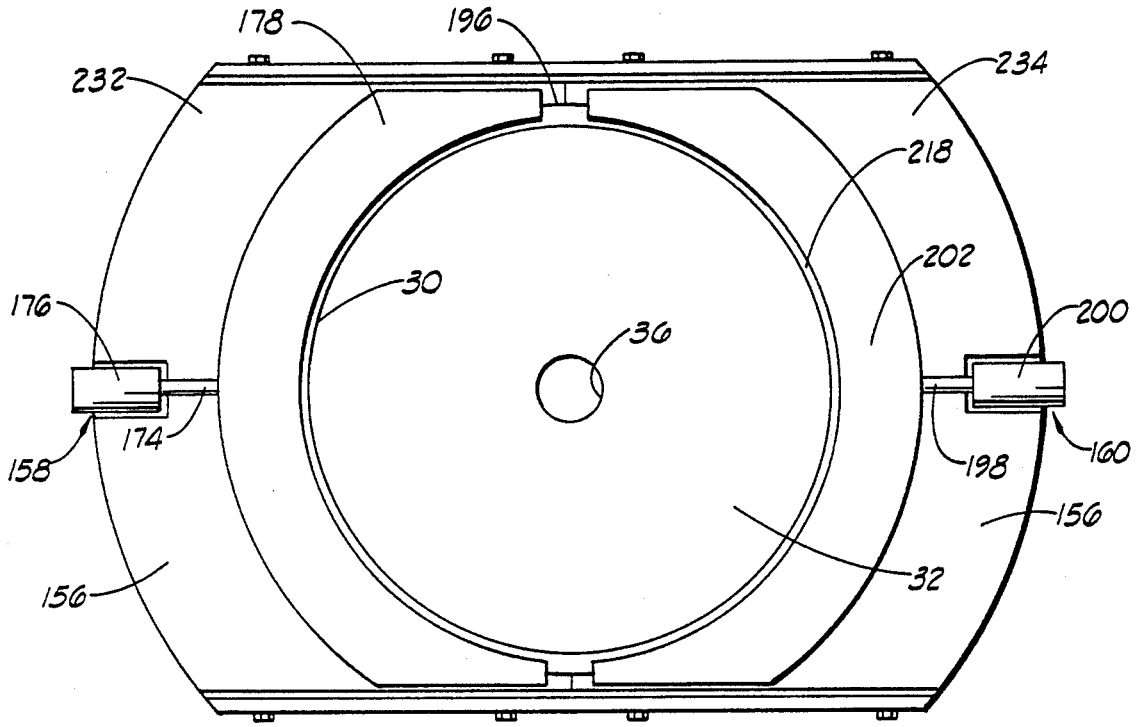
FIG. 5 is a top plan view of the rotating head with the upper housing plate removed.
Figure 4A:
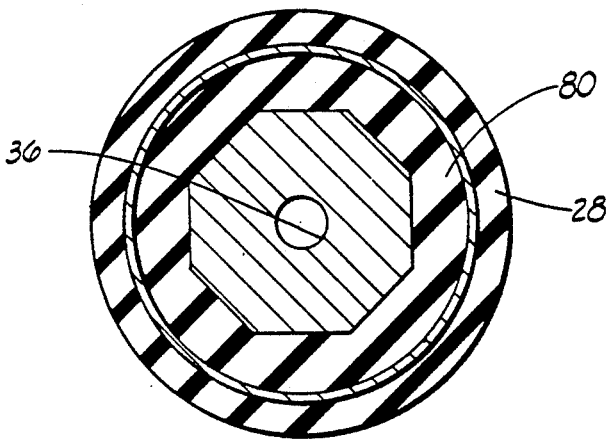
FIG. 4*a* is a plan view of the insert in the elastomeric member shown in section with the elastomeric member removed from the upper portion of the insert.

As shown in FIGS. 1 and 5, a first rod 174 is disposed in the clamp opening 168 of the clamp housing 156. One end of the first rod 174 is connected to a first air operated cylinder 176.

A semi-circular bearing plate 178 (FIGS. 1 and 5) is connected to the first rod 174. An angled edge 196 (FIG. 1) is formed on the bearing plate 178. The angled edge 196 forms a bearing surface in the bearing plate 178 which is shaped and positioned to bearingly engage a portion of the upper bearing wall 88 formed on the upper end 32 of the elastomeric member 28.

A second rod 198 (FIGS. 1 and 5) is disposed in the second opening 172 of the clamp housing 156. One end of the second rod 198 is connected to a second air operated cylinder 200 (FIGS. 1 and 5).

A semi-circular bearing plate 202 (FIGS. 1 and 5) is connected to the second rod 198. An angled edge 218 (FIG. 1) is formed on the second rod 198. The angled edge 218 forms a bearing surface and is shaped and positioned to bearingly engage a portion of the upper bearing wall 88 formed on the upper end 32 of the elastomeric member 28.

Figure 6:
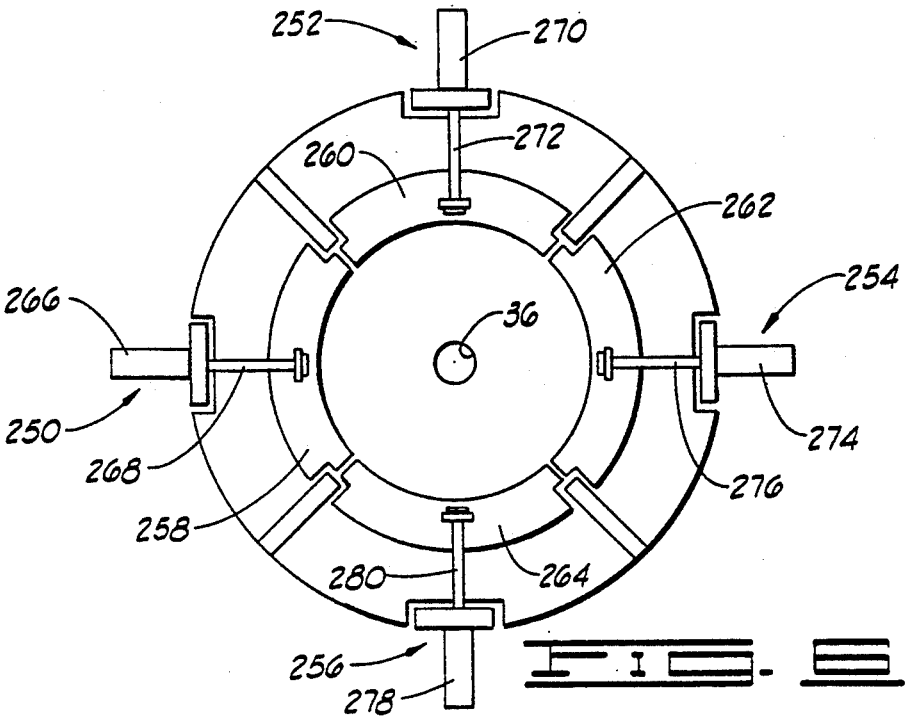
FIG. 6 is a top plan view similar to FIG. 5, but showing a modified rotating with the upper housing plate removed.

In lieu of the rotating head 10 having two clamp means 158, 160 and two semi-circular bearing plates 178, 202, as shown in FIG. 5, a rotating head having four clamp means 250, 252, 254, and 256, and four bearing plates, 258, 260, 262 and 264 as shown in the embodiment of FIG. 6 may be utilized. The bearing plates 258–264 are disposed such that each of the bearing plates 258–264 is positioned about 90° from the adjacent bearing plates.

The clamp means 250–256 are similar in construction to the clamp means 158, 160, with the exceptions noted above. Thus, the bearing plate 258 is connected to an air operated cylinder 266 via rod 268; bearing plate 260 is connected to an air operated cylinder 270 via rod 272; bearing plate 262 is connected to an air operated cylinder 274 via rod 276; and bearing plate 264 is connected to an air operated cylinder 278 via rod 280.

The clamp housing 156 more particularly comprises an upper housing plate 230 (FIGS. 1 and 5) and a pair of lower housing plate 232 and 234 (FIG. 5).

The clamp housing 156 is removed from the outer bowl 12. Then, the rotating assembly 14 is disposed in the bowl opening 13 to a position wherein the lower bearing wall 90 on the elastomeric member 28 engages the bearing surface 148 formed on the wear insert 122. In this position, the upper seal member 49 on the sealing flange 50 is disposed in the annular seal recess 149 and sealingly engages the wear insert 122 and the lower seal member 52 engages the lower end 126 of the wear insert 122.

The clamp housing 156 then is connected to the upper end 16 of the outer bowl 12. The first and the second rods 174 and 198 initially are positioned so that the first and the second rods 174 and 198 have been moved in respective directions 194 and 216 to a position wherein the bearing surfaces formed by the angled edges 196 and 218 on the respective bearing plates 178 and 202 each are spaced a distance from the recess 162. After the clamp housing 156 has been secured to the upper end 16 of the outer bowl 12, the cylinders 176 and 200 are actuated to move the first and the second rods 174 and 198 in the respective directions 192 and 214 to a position wherein the bearing surface formed by the angled edge 196 on the bearing plate 178 engages the upper bearing wall 88 on the elastomeric member 28 and the bearing surface 218 on the bearing plate 202 engages a portion of the upper bearing wall 88 on the elastomeric member 28. The rotating assembly 14 is bearingly supported in the outer bowl 12 via tapered upper and the lower bearing walls 88 and 90 formed on the elastomeric member 28 and the bearing surface 148 formed on the wear insert 122 and the angled edges 196 and 218 on the first and the second rods 174 and 198. As the bearing surfaces 88, 90, 196, 218 and 148 wear, the first and the second rods 174 and 198 can be adjusted inwardly and outwardly to provide the proper bearing engagement.

When the drill pipe 38 is drivingly rotated, the elastomeric member 28 is drivingly rotated due to the gripping engagement between the elastomeric member 28 and the drill pipe 38. As the rotating assembly 14 rotates, upper seal member 49 and the lower seal member 52 sealing engage the wear insert 122 for providing sealing engagement between the rotating assembly 14 and the outer bowl 12.

If the rotating bushing 30 or the elastomeric member 28 becomes worn or otherwise in need of repair or replacement, the clamp housing 156 is unbolted and remove from the outer bowl 12. In this position of the clamp housing 156, the elastomeric member 28 is removed from the bowl opening 13. After removal of the elastomeric member 28, a new or repaired elastomeric member 28 then can be installed in the bowl opening 13 and the clamp housing 156 then can be reassembled to the outer bowl 12. The replacement of the elastomeric member 28 replaces the bearing and the sealing members.

EMBODIMENT OF FIG. 7

Figure 7:
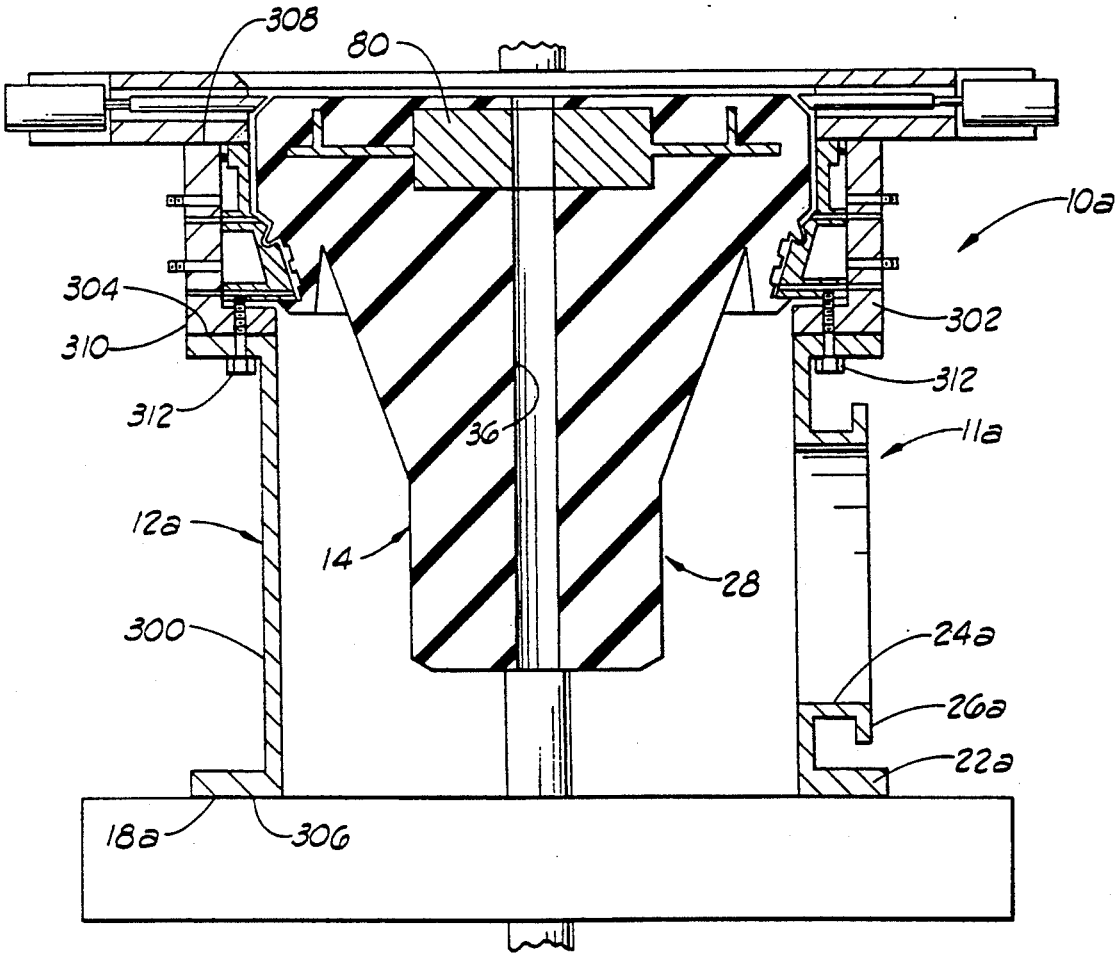
FIG. 7 is a sectional view of a modified rotating head.

Shown in FIG. 7 is a rotating head 10*a* which is constructed exactly like the rotating head 10 described in detail before, except the rotating 10*a* includes a modified bowl assembly 11*a*. The modified bowl assembly of 11*a* includes a lower bowl 300 and an upper bowl 302.

The lower bowl 300 has an upper end 304 and a lower end 306. A portion of the bowl opening 13*a* is formed through the lower bowl 300 intersecting the upper end 304 and the lower end 306 of the lower bowl 300. A discharge opening 24*a* is formed through the lower bowl 300.

The upper bowl 302 has an upper end 308 and a lower end 310. A portion of a bowl opening 13*a* is formed through the upper bowl 302 intersecting the upper and the lower nd 308 and 310 thereof. The upper bowl 302 is connected to the lower bowl 300 by way of a plurality of bolts 312 (only two bolts 312 being shown in FIG. 7). In the assembled position of the lower bowl 300 and the upper bowl 302, the bowl openings in the lower bowl 300 and the upper bowl 302 cooperate to form the bowl opening 13 in the bowl assembly 11*a*. The rotating assembly 14 is constructed exactly like the rotating assembly described in detail before and the rotating assembly 14 is supported within the upper bowl 302.

Utilizing the construction of the bowl assembly 11*a* shown in FIG. 7, the lower bowl 300 can be removed and interchanged with a lower bowl 300 of a different size to fit different blow-out preventers without the necessity of having to purchase an entire new bowl assembly.

Changes may be made in the construction and the operation of the various components, elements and assemblies described herein without departing from the spirit and scope of the invention as defined in the following claims.

What is claimed is:

1. A rotating head adapted for use in drilling a well borehole at a well drilling site wherein drilling fluid is passed into the well borehole and wherein some of the drilling fluid is passed from the well borehole and wherein a rotatable drill pipe extends into the well borehole during the drilling operation, comprising:

a bowl assembly having a bowl opening and a discharge opening, the bowl assembly being adapted to receive drilling fluid into the bowl opening and pass the drilling fluid through the discharge opening; and a rotating assembly disposed in the bowl opening consisting of:

an elastomeric member having an upper end, a lower end, an elastomeric member outer peripheral surface and a drive opening extending through the elastomeric member intersecting the upper end and the lower end of the elastomeric member, the elastomeric member being disposed in the bowl opening in an operating position, a portion of the elastomeric member defining sealing means for providing sealing engagement between the bowl assembly and a portion of the elastomeric member, the elastomeric member further defining bearing wall means for bearingly engaging the bowl assembly and for rotatingly supporting the rotating assembly in the bowl opening, the drill pipe being extendable through the drive opening in the elastomeric member and the elastomeric member grippingly engaging the drill pipe, and the rotating of the drill pipe causing the rotating of the rotating assembly due to the gripping engagement between the elastomeric member and the drill pipe.

2. The rotating head of claim 1 wherein the elastomeric member is defined further to comprise a cylindrically shaped portion extending from the upper end of the elastomeric member a distance toward the lower end of the elastomeric member terminating with a lower end of the cylindrically shaped portion and having a substantially flat, vertically extending outer peripheral surface forming a portion of the elastomeric outer peripheral surface, and wherein the bearing wall means of the elastomeric member comprises:

a tapered lower bearing wall formed on the cylindrically shaped portion of the elastomeric member near the lower end of the cylindrically shaped portion, the lower bearing wall intersecting the vertically extending outer peripheral surface of the cylindrically shaped portion and the lower bearing wall extending circumferentially about the elastomeric member; and a tapered upper bearing wall formed on the upper end of the elastomeric member intersecting the vertically extending outer peripheral surface of the cylindrically shaped portion with the upper bearing wall extending circumferentially about the elastomeric member, and the upper bearing wall and the lower bearing wall each bearingly engaging a portion of the bowl assembly for bearingly supporting the elastomeric member in the bowl assembly.

3. The rotating head of claim 2 wherein the sealing means of the elastomeric member comprises a seal flange formed on the elastomeric member having an outer peripheral surface tapered inwardly toward the drive bore in the elastomeric member, the seal flange extending from the lower end of the cylindrically shaped portion of the elastomeric member a distance toward the lower end of the elastomeric member, the outer peripheral surface of the seal flange sealingly engaging a portion of the bowl assembly so as to form the seal between the rotating assembly and the bowl assembly, the outer peripheral surface of the seal flange forming a portion of the outer peripheral surface of the elastomeric member.

4. The rotating head of claim 3 wherein the seal flange further comprises an annular upper seal member formed on the outer peripheral surface of the seal flange with the upper seal member extending a distance from the outer peripheral surface of the seal flange, and the upper seal member sealingly engaging a portion of the bowl assembly.

5. The rotating head of claim 4 wherein the seal flange further comprises an annular lower seal member formed on the outer peripheral surface of the seal flange, the lower seal member sealingly engaging a portion of the bowl assembly.

6. The rotating head of claim 2 wherein the bowl assembly further comprises:

a wear insert having an upper end, a lower end, an inner peripheral surface and an outer peripheral surface, a portion of the inner peripheral surface of the wear insert sealingly engaging a portion of the sealing means of the elastomeric member, the wear insert being disposed in the bowl assembly.

7. The rotating head of claim 6 wherein the sealing means of the elastomeric member comprises a seal flange formed on the elastomeric member, the seal flange having an outer peripheral surface tapered inwardly toward the drive bore in the elastomeric member, the seal flange extending from the lower end of the cylindrically shaped portion of the elastomeric member a distance toward the lower end of the elastomeric member, the outer peripheral surface of the seal flange sealingly engaging a portion of the wear insert so as to form a seal between the rotating assembly and the bowl assembly, and the outer peripheral surface of the seal flange forming a portion of the outer peripheral surface of the elastomeric member.

8. The rotating head of claim 7 wherein the seal flange further comprises an annular upper seal member formed on the outer peripheral surface of the seal flange with the upper seal member extending a distance from the outer peripheral surface of the seal flange and the upper seal member sealingly engaging a portion of the wear insert.

9. The rotating head of claim 6 wherein the wear insert is further defined as comprising a bearing surface formed on the inner peripheral surface of the wear insert generally between the upper and the lower ends of the wear insert, the lower bearing wall on the elastomeric member bearingly engaging the bearing surface formed on the wear insert.

10. The rotating head of claim 9 wherein the bowl assembly further comprises means for bearingly engaging the upper bearing wall on the elastomeric member, said means being adjustable for adjusting the position of said means with respect to the upper bearing wall on the elastomeric member.

11. The rotating head of claim 2 wherein the elastomeric member is further defined as being constructed of an elastomeric material having a consistent hardness throughout and wherein the elastomeric member further comprises reinforcing means disposed in the elastomeric member generally about the cylindrically shaped portion for reinforcing the upper bearing wall and the lower bearing wall.

12. The rotating head of claim 11 wherein the elastomeric member is constructed of the elastomeric material having a hardness of about sixty Shore D.

13. The rotating head of claim 1 wherein the bowl assembly further comprises:

a lower bowl having an upper end and a lower end with an opening extending therethrough intersecting the upper and the lower ends thereof and forming a portion of the bowl opening, the discharge opening being formed through a portion of the lower bowl, the lower bowl being adapted to receive drilling fluid into the portion of the bowl opening formed through the lower bowl and pass the drilling fluid through the discharge opening in the lower bowl; and an upper bowl having an upper end and a lower end with an opening extending therethrough intersecting the upper and the lower ends thereof and forming a portion of the bowl opening, the lower end of the upper bowl being removably connected to the upper end of the lower bowl, the rotating assembly being disposed within the opening in the upper bowl.

14. A rotating head adapted for use in drilling a well borehole at a well drilling site wherein drilling fluid is passed into the well borehole and wherein some of the drilling fluid is passed from the well borehole and wherein a rotatable drill pipe extends into the well borehole during the drilling operation, comprising:

a bowl assembly having a bowl opening and a discharge opening, the bowl assembly being adapted to receive drilling fluid into the bowl opening and pass the drilling fluid through the discharge opening;

a wear insert having an upper end, a lower end, an inner peripheral surface, a seal recess formed in the inner peripheral surface and an outer peripheral surface, the wear insert being disposed in the bowl assembly; and a rotating assembly disposed in the bowl opening consisting of:

an elastomeric member having an upper end, a lower end, an elastomeric member outer peripheral surface and a drive opening extending through the elastomeric member intersecting the upper end and the lower end of the elastomeric member, the elastomeric member defined further to comprise:

a cylindrically shaped portion extending from the upper end of the elastomeric member a distance toward the lower end of the elastomeric member terminating with a lower end of the cylindrically shaped portion and having a substantially flat, vertically extending outer peripheral surface forming a portion of the elastomeric outer peripheral surface;

a tapered lower bearing wall formed on the cylindrically shaped portion near the lower end of the cylindrically shaped portion, the lower bearing wall intersecting the vertically extending outer peripheral surface of the cylindrically shaped portion and the lower bearing wall extending circumferentially about the elastomeric member;

a tapered upper bearing wall formed on the upper end of the elastomeric member intersecting the vertically extending outer peripheral surface of the cylindrically shaped portion with the upper bearing wall extending circumferentially about the elastomeric member, the upper bearing wall and the lower bearing wall each bearingly engaging a portion of the bowl assembly for bearingly supporting the elastomeric member in the bowl opening of the bowl assembly; and a seal flange formed on the elastomeric member having an outer peripheral surface tapered inwardly toward the drive bore in the elastomeric member, the seal flange extending from the lower end of the cylindrically shaped portion of the elastomeric member a distance toward the lower end of the elastomeric member, the outer peripheral surface of the seal flange sealingly engaging a portion of the wear insert for forming a seal between the rotating assembly and the bowl assembly, and the outer peripheral surface of the seal flange forming a portion of the outer peripheral surface of the elastomeric member, the seal flange further comprises an annular upper seal member formed on the outer peripheral surface of the seal flange with the upper seal member extending a distance from the outer peripheral surface of the seal flange, the upper seal member being disposed in the seal recess of the wear insert so as to sealingly engage a portion of the wear insert, such that, in an operating position, the upper seal member of the elastomeric member sealingly engages the wear insert of the bowl assembly and the upper and lower bearing walls of the elastomeric member bearingly engages the bowl assembly for rotatingly supporting the rotating assembly in the bowl opening, the drill pipe being extendable through the drive opening in the elastomeric member and the elastomeric member grippingly engaging the drill pipe, and the rotating of the drill pipe causing the rotating of the rotating assembly due to the gripping engagement between the elastomeric member and the drill pipe.

15. The rotating head of claim 14 wherein the seal flange further comprises a lower seal member extending a distance from the outer peripheral surface of the seal flange and sealingly engaging a portion of the wear insert near the lower end of the wear insert.

16. An improvement in a rotating assembly adapted for use in a rotating head wherein the rotating head is adapted for use in drilling a well borehole at a well drilling site wherein drilling fluid is passed into the well borehole and wherein some of the drilling fluid is passed from the well borehole and wherein a rotatable drill pipe extends into the well borehole during the drilling operation, the rotating head comprising a bowl assembly having a bowl opening and a discharge opening, the bowl assembly being adapted to receive drilling fluid into the bowl opening and pass the drilling fluid through the discharge opening, the improvement comprising:

a rotating assembly disposed in the bowl opening of the bowl assembly, the rotating assembly consisting of:

an elastomeric member having an upper end, a lower end, an elastomeric member outer peripheral surface and a drive opening extending through the elastomeric member intersecting the upper end and the lower end of the elastomeric member, the elastomeric member having sealing means for sealingly engaging the bowl assembly, the elastomeric member further having bearing wall means for bearingly engaging the bowl assembly for rotatingly supporting the rotating assembly in the bowl opening of the bowl assembly, the drill pipe being extendable through the drive opening and the elastomeric member grippingly engaging the drill pipe, and the rotating of the drill pipe causing the rotation of the rotating assembly due to the gripping engagement between the elastomeric member and the drill pipe.

17. The improvement of claim 16 wherein the elastomeric member is defined further to comprise a cylindrically shaped portion extending from the upper end of the elastomeric member a distance toward the lower end of the elastomeric member terminating with a lower end of the cylindrically shaped portion and having a substantially flat, vertically extending outer peripheral surface forming a portion of the elastomeric member outer peripheral surface.

18. The improvement of claim 17 wherein the bearing wall means of the elastomeric member comprises a tapered lower bearing wall and a tapered upper bearing wall, the tapered lower bearing wall formed on the cylindrically shaped portion of the elastomeric member near the lower end of the cylindrically shaped portion, the lower bearing wall intersecting the vertically extending outer peripheral surface of the cylindrically shaped portion and the lower bearing wall extending circumferentially about the elastomeric member, the tapered upper bearing wall formed on the upper end of the elastomeric member intersecting the vertically extending outer peripheral surface of the cylindrically shaped portion with the upper bearing wall extending circumferentially about the elastomeric member, the upper bearing wall and the lower bearing wall each bearingly engaging a portion of the bowl assembly for bearingly supporting the elastomeric member in the bowl assembly.

19. The improvement of claim 18 wherein the sealing means of the elastomeric member comprises a seal flange formed on the elastomeric member having an outer peripheral surface tapered inwardly toward the drive bore in the elastomeric member, the seal flange extending from the lower end of the cylindrically shaped portion of the elastomeric member a distance toward the lower end of the elastomeric member, the outer peripheral surface of the seal flange sealingly engaging a portion of the bowl assembly so as to form the seal between the rotating assembly and the bowl assembly, the outer peripheral surface of the seal flange forming a portion of the elastomeric member outer peripheral surface of the elastomeric member.

20. The improvement of claim 19 wherein the seal flange comprises an annular upper seal member formed on the outer peripheral surface of the seal flange with the upper seal member extending a distance from the outer peripheral surface of the seal flange, and the upper seal member sealingly engaging a portion of the bowl assembly.

21. The improvement of claim 20 wherein the seal flange further comprises an annular lower seal member formed on the outer peripheral surface of the seal flange, the lower seal member sealingly engaging a portion of the bowl assembly.

22. The improvement of claim 18 further comprising:

a wear insert having an upper end, a lower end, an inner peripheral surface and an outer peripheral surface, a portion of the inner peripheral surface of the wear insert sealingly engaging a portion of the elastomeric member, the wear insert being disposed in the bowl assembly.

23. The improvement of claim 22 wherein the sealing means of the elastomeric member further comprises a seal flange formed on the elastomeric member, the seal flange having an outer peripheral surface tapered inwardly toward the drive bore in the elastomeric member, the seal flange extending from the lower end of the cylindrically shaped portion of the elastomeric member a distance toward the lower end of the elastomeric member, the outer peripheral surface of the seal flange sealingly engaging a portion of the wear insert so as to form the seal between the rotating assembly and the bowl assembly, the outer peripheral surface of the seal flange forming a portion of the elastomeric member outer peripheral surface of the elastomeric member.

24. The improvement of claim 23 wherein the seal flange further comprises an annular upper seal member formed on the outer peripheral surface of the seal flange with the upper seal member extending a distance from the outer peripheral surface of the seal flange and the upper seal member sealingly engaging a portion of the wear insert.

25. The improvement of claim 27 wherein the wear insert is further defined as comprising a bearing surface formed on the inner peripheral surface of the wear insert generally between the upper and the lower ends of the wear insert, the lower bearing wall of the bearing means on the elastomeric member bearingly engaging the the wear insert.

26. The improvement of claim 25 further comprises means supported by the bowl assembly for bearingly engaging the upper bearing wall of the bearing means on the elastomeric member, said means being adjustable for adjusting the position of said means with respect to the upper bearing wall of the bearing means on the elastomeric member.

27. The improvement of claim 18 wherein the elastomeric member is further defined as being constructed of an elastomeric material having a consistent hardness throughout and wherein the elastomeric member further comprises reinforcing means disposed in the elastomeric member generally about the cylindrically shaped portion for reinforcing the upper bearing wall and the lower bearing wall.

28. The improvement of claim 27 wherein the elastomeric member is constructed of the elastomeric material having a hardness of about sixty Shore D.

29. An improvement in a rotating assembly adapted for use in a rotating head wherein the rotating head is adapted for use in drilling a well borehole at a well drilling site wherein drilling fluid is passed into the well borehole and wherein some of the drilling fluid is passed from the well borehole and wherein a rotatable drill pipe extends into the well borehole during the drilling operation, the rotating head comprising a bowl assembly having a bowl opening and a discharge opening, the bowl assembly being adapted to receive drilling fluid into the bowl opening and pass the drilling fluid through the discharge opening, the improvement comprising:

a wear insert disposed in the bowl assembly, the wear insert having an upper end, a lower end, an inner peripheral surface, a seal recess formed in the inner peripheral surface and an outer peripheral surface;

a rotating assembly disposed in the bowl opening of the bowl assembly, the rotating assembly consisting of:

an elastomeric member having an upper end, a lower end, an elastomeric member outer peripheral surface and a drive opening extending through the elastomeric member intersecting the upper end and the lower end of the elastomeric member, the elastomeric member sealingly engaging the bowl assembly and the elastomeric member bearingly engaging the bowl assembly for rotatingly supporting the rotating assembly in the bowl opening, the drill pipe being extendable through the drive opening and the elastomeric member grippingly engaging the drill pipe, and the rotating of the drill pipe causing the rotation of the rotating assembly due to the gripping engagement between the elastomeric member and the drill pipe, the elastomeric member defined to further comprise:

a cylindrically shaped portion extending from the upper end of the elastomeric member a distance toward the lower end of the elastomeric member terminating with a lower end of the cylindrically shaped portion and having a substantially flat, vertically extending outer peripheral surface forming a portion of the elastomeric outer peripheral surface;

a tapered lower bearing wall formed on the cylindrically shaped portion near the lower end of the cylindrically shaped portion of the elastomeric member, the lower bearing wall intersecting the vertically extending outer peripheral surface of the cylindrically shaped portion and the tapered lower bearing wall extending circumferentially about the elastomeric member; and a tapered upper bearing wall formed on the upper end of the elastomeric member intersecting the vertically extending outer peripheral surface of the cylindrically shaped portion with the upper bearing wall extending circumferentially about the elastomeric member, the tapered upper bearing wall and the lower bearing wall each bearingly engaging a portion of the bowl assembly for bearingly supporting the elastomeric member in the bowl opening of the bowl assembly; and a seal flange formed on the elastomeric member having an outer peripheral surface tapered inwardly toward the drive bore in the elastomeric member, the seal flange extending from the lower end of the cylindrically shaped portion of the elastomeric member a distance toward the lower end of the elastomeric member, the outer peripheral surface of the seal flange forming a portion of the outer peripheral surface of the elastomeric member, the seal flange further comprising an annular upper seal member formed on the outer peripheral surface of the seal flange with the upper seal member extending a distance from the outer peripheral surface of the seal flange, the upper seal member disposed in the seal recess of the wear insert for forming a seal between the elastomeric member of the rotating assembly and a portion of the inner peripheral surface of the wear insert disposed in the bowl assembly.

30. The improvement of claim 29 wherein the seal flange further comprises a lower seal member extending a distance from the outer peripheral surface of the seal flange and sealingly engaging a portion of the wear insert near the lower end of the wear insert.

31. A rotating head adapted for use in drilling a well borehole at a well drilling site wherein drilling fluid is passed into the well borehole and wherein some of the drilling fluid is passed from the well borehole and wherein a rotatable drill pipe extends into the well borehole during the drilling operation, comprising:

a bowl assembly having a bowl opening and a discharge opening, the bowl assembly being adapted to receive drilling fluid into the bowl opening and pass the drilling fluid through the discharge opening, the bowl assembly comprising:

an outer bowl having an upper end and a lower end, the bowl opening extending through the outer bowl intersecting the upper end and the lower end of the outer bowl;

a wear insert having an upper end, a lower end, an inner peripheral surface and an outer peripheral surface, the wear insert being disposed in the bowl opening near the upper end of the outer bowl; and a rotating assembly disposed in the bowl opening, consisting of: an elastomeric member having an upper end, a lower end, an elastomeric outer peripheral surface and a drive opening extending through the elastomeric member intersecting the upper end and the lower end of the elastomeric member, the elastomeric member having a cylindrically shaped portion extending from the upper end of the elastomeric member a distance toward the lower end of the elastomeric member terminating with a lower end of the cylindrically shaped portion, the cylindrically shaped portion having a substantially flat, vertically extending outer peripheral surface forming a portion of the elastomeric outer peripheral surface, the elastomeric member defining an upper bearing wall and a lower bearing wall, the upper bearing wall formed on the cylindrically shaped portion of the elastomeric member near the upper end of the elastomeric member so that the upper bearing wall extends circumferentially about the elastomeric member, the lower bearing wall formed on the elastomeric member near the lower end of the cylindrically shaped portion of the elastomeric member so that the lower bearing wall extends circumferentially about the elastomeric member, a seal flange having an outer peripheral surface, the seal flange formed on the elastomeric member near the lower end of the cylindrically shaped portion, the outer peripheral surface of the seal flange sealingly engaging a portion of the wear insert and the upper and the lower bearing walls bearingly engaging a portion of the wear insert and a portion of the bowl assembly for bearingly supporting the elastomeric member in the bowl opening of the outer bowl.

32. The rotating head of claim 31 wherein the seal flange further comprises an annular upper seal member formed on the outer peripheral surface of the seal flange such that the annular upper seal member extends a distance from the outer peripheral surface of the seal flange and the upper seal member sealingly engaging a portion of the wear insert.

33. A rotating head adapted for use in drilling a well borehole at a well drilling site wherein drilling fluid is passed into the well borehole and wherein some of the drilling fluid is passed from the well borehole and wherein a rotatable drill pipe extends into the well borehole during the drilling operation, comprising:

a bowl assembly having a bowl opening and a discharge opening, the bowl assembly being adapted to receive drilling fluid into the bowl opening and passed the drilling fluid through the discharge opening, the bowl assembly comprising:

an outer bowl having an upper end and a lower end, the bowl opening extending through the outer bowl so as to intersect the upper end and the lower end of the outer bowl; and a wear insert having an upper end, a lower end, an inner peripheral surface having a seal recess formed therein and an outer peripheral surface, the wear insert being disposed in the bowl opening near the upper end of the outer bowl;

a rotating assembly disposed in the bowl opening, the rotating assembly consisting of:

an elastomeric member having an upper end, a lower end, an elastomeric outer peripheral surface and a drive opening extending through the elastomeric member intersecting the upper end and the lower end of the elastomeric member, the elastomeric member having a cylindrically shaped portion extending from the upper end of the elastomeric member a distance toward the lower end of the elastomeric member terminating with a lower end of the cylindrically shaped portion, the cylindrically shaped portion having a substantially flat, vertically extending outer peripheral surface forming a portion of the elastomeric outer peripheral surface;

an upper bearing wall formed on the cylindrically shaped portion near the upper end of the elastomeric member such that the upper bearing wall extends circumferentially about the elastomeric member;

a lower bearing wall formed on the elastomeric member near the lower end of the cylindrically shaped portion such that the lower bearing wall extends circumferentially about the elastomeric member; and a seal flange formed on the elastomeric member near the lower end of the cylindrically shaped portion, the seal flange having an outer peripheral surface and further comprising an annular upper seal member formed on the outer peripheral surface of the seal flange such that the annular upper seal member extends a distance from the outer peripheral surface of the seal flange, the annular upper seal member disposable in the seal recess formed in the inner peripheral surface of the wear insert so that the annular upper seal member sealingly engages a portion of the wear insert and the upper and the lower bearing walls bearingly engage a portion of the wear insert and a portion of the bowl assembly for bearingly supporting the elastomeric member in the bowl opening of the outer bowl.

34. The rotating head of claim 33 wherein the seal flange further comprises a lower seal member extending a distance from the outer peripheral surface of the seal flange and sealingly engaging a portion of the wear insert near the lower end of the wear insert.

35. The rotating head of claim 33 wherein the wear insert is further defined as comprising a bearing surface formed on the inner peripheral surface of the wear insert generally between the upper and the lower ends of the wear insert, the lower bearing wall on the elastomeric member bearingly engaging the bearing surface formed on the wear insert.

36. The rotating head of claim 35 wherein the bowl assembly further comprises means for bearingly engaging the upper bearing wall on the elastomeric member, said means being adjustable for adjusting the position of said means with respect to the upper bearing wall on the elastomeric member.

37. The rotating head of claim 33 wherein the elastomeric member is further defined as being constructed of an elastomeric material having a consistent hardness throughout and wherein the elastomeric member further comprises reinforcing means disposed in the elastomeric member generally about the cylindrically shaped portion for reinforcing the upper bearing wall and the lower bearing wall.

38. The rotating head of claim 37 wherein the elastomeric member is constructed of the elastomeric material having a hardness of about sixty Shore D.

39. The rotating head of claim 33 wherein the outer bowl further comprises:

a lower bowl having an upper end and a lower end with an opening extending therethrough intersecting the upper and the lower ends thereof and forming a portion of the bowl opening, the discharge opening being formed through a portion of the lower bowl, the lower bowl being adapted to receive drilling fluid into the portion of the bowl opening formed through the lower bowl and pass the drilling fluid through the discharge opening in the lower bowl; and an upper bowl having an upper end and a lower end with an opening extending therethrough intersecting the upper and the lower ends thereof and forming a portion of the bowl opening, the lower end of the upper bowl being removably connected to the upper end of the lower bowl, the rotating assembly being disposed within the opening in the upper bowl.

* * * * *

UNITED STATES PATENT AND TRADEMARK OFFICE

CERTIFICATE OF CORRECTION

PATENT NO. : 5,322,137

DATED : June 21, 1994

INVENTOR(S) : Don E. Gonzales

It is certified that error appears in the above-identified patent and that said Letters Patent is hereby corrected as shown below:

Column 1, Line 15, after the, please delete "rotting" and substitute therefor --rotating--.

Column 1, Line 27, after rotating, please insert --head--.

Column 1, Line 61; after 4 and 5)., please delete "the" and substitute therefor -- The--.

Column 2, Line 54; after bearingly, please delete "supported" and substitute therefor --supporting--.

Column 4, Line 22; after wear, please delete "inset" and substitute therefor --insert--.

Column 5, Line 2; after bowl 12, please delete "Via" and substitute therefor --via--.

Column 6, Line 55; please delete "remove" and substitute therefor --removed--.

UNITED STATES PATENT AND TRADEMARK OFFICE

CERTIFICATE OF CORRECTION

PATENT NO. : 5,322,137

DATED : June 21, 1994

INVENTOR(S) : Don E. Gonzales

It is certified that error appears in the above-identified patent and that said Letters Patent is hereby corrected as shown below:

Column 6, Line 68, after rotating, please insert --head--.

Column 7, Line 12, after lower, please delete "nd" and substitute therefor --end--.

Column 12, Line 27, after claim, please delete "27" and substitute therefor --22--.

Signed and Sealed this

First Day of November, 1994

Bruce Lehman

*Attest:*

BRUCE LEHMAN

*Attesting Officer*

*Commissioner of Patents and Trademarks*